United States Patent [19]

Fisher

[11] 4,061,318

[45] Dec. 6, 1977

[54] METALLURGICAL VESSEL

[75] Inventor: Howard M. Fisher, New Castle, Pa.

[73] Assignee: Pennsylvania Engineering Corporation, Pittsburgh, Pa.

[21] Appl. No.: 711,733

[22] Filed: Aug. 5, 1976

[51] Int. Cl.[2] ..... C21C 5/46

[52] U.S. Cl. ..... 266/246

[58] Field of Search ..... 75/60; 266/218, 220–224, 266/243, 245–247, 265–270

[56] References Cited

U.S. PATENT DOCUMENTS

| | | | |
|---|---|---|---|
| 3,502,314 | 3/1970 | Puhringer | 266/246 |
| 3,799,527 | 3/1974 | Fisher | 266/246 |

FOREIGN PATENT DOCUMENTS

| | | | |
|---|---|---|---|
| 247,501 | 9/1962 | Australia | 266/246 |

*Primary Examiner*—Gerald A. Dost

*Attorney, Agent, or Firm*—Fred Wiviott

[57] ABSTRACT

An open-topped, refractory lined converter vessel has a plurality of tap openings and is supported on a trunnion ring by means of an adapter which is coupled to the vessel mounting brackets. A plurality of retention members are supported in the trunnion ring for vertical movement into and out of equispaced openings in the trunnion ring top flange and the adapter. A plurality of releasably engagable key members are adapted to engage the adapter and the pins for securing the adapter to the trunnion ring. A plurality of bottom brackets are slidably mounted on the trunnion ring for movement into and out of engagement with the vessel for additional support when the latter is tilted. A lift mechanism is provided for elevating the vessel and rotating the same to an alternate position whereupon after reconnection, a different cne of the tap openings is positioned to have molten metal poured therefrom.

19 Claims, 8 Drawing Figures

METALLURGICAL VESSEL

BACKGROUND OF THE INVENTION

Pneumatic steel making vessels generally include an open-topped, refractory lined steel shell for containing a charge of molten metal. Oxygen gas is commonly delivered to the metallic charge either by a lance or tuyeres which extend through the bottom or sides of the vessel. Hot metal or scrap is initially charged into the vessel through its open top. Vessels of this type are normally supported by a trunnion ring affixed to the vessel and trunnion pins extending outwardly from the ring so that the vessel may be tilted to receive a hot metal or scrap charge and also for pouring molten metal from a tap hole on the upper side of the vessel after the conversion operation has been completed.

Tiltable converter vessels of this type generally have a single tap hole located in an upper portion of the vessel and generally in a plane 90° from the vessel tilt axis. After a period of operation, deformation occurs in the vessel and refractory lining in the area of the tap opening because of the extreme heat and internal refractory loading as a result of the hot metal when the vessel is tilted for tapping and also from the radiant heat of the teeming ladle into which the hot metal is tapped. This deformation in the area of the tap opening is progressive and eventually the refractory in this area must be replaced as a result of its warped contour.

One prior art method of alleviating this problem is discussed in U.S. Pat. No. 3,831,917 and consists of rotating the vessel relative to the trunnion ring. This is accomplished by three support pins arranged equilaterally around the vessel periphery and releasably securable to the vessel for eccentric rotation so that the angle of inclination of the pin may be adjusted relative to the vessel for being coupled to a U-shaped trunnion support in any one of three positions. When this vessel is to be rotated, it is necessary not only to disconnect the vessel support from the trunnion support but it is also necessary to disconnect and rearrange the vessel support pins. This problem is also the subject of U.S. Pat. No. 3,005,628 which discloses a refractory lined vessel which may be elevated and rotated relative to a trunnion ring for purposes of more even wear. In the latter patent, however, the vessel pouring spout is located in a removable cover so that inordinate wear of this portion of the total vessel would not be alleviated by rotation since the cover would always have to remain in the same relative position with respect to the vessel tilt axis.

SUMMARY OF THE INVENTION

It is an object of the invention to provide a refractory lined converter vessel which may be rapidly and easily disconnected from its trunnion ring for rotation relative to its tilt axis.

Another object of the invention is to provide a converter vessel trunnion ring having means for facilitating disconnection for the vessel so that the latter may be rotated to define a new vessel tilt axis.

A further object of the invention is to provide apparatus for elevating and rotating a converter vessel relative to its trunnion ring.

DESCRIPTION OF THE PREFERRED EMBODIMENT

Figure 1:
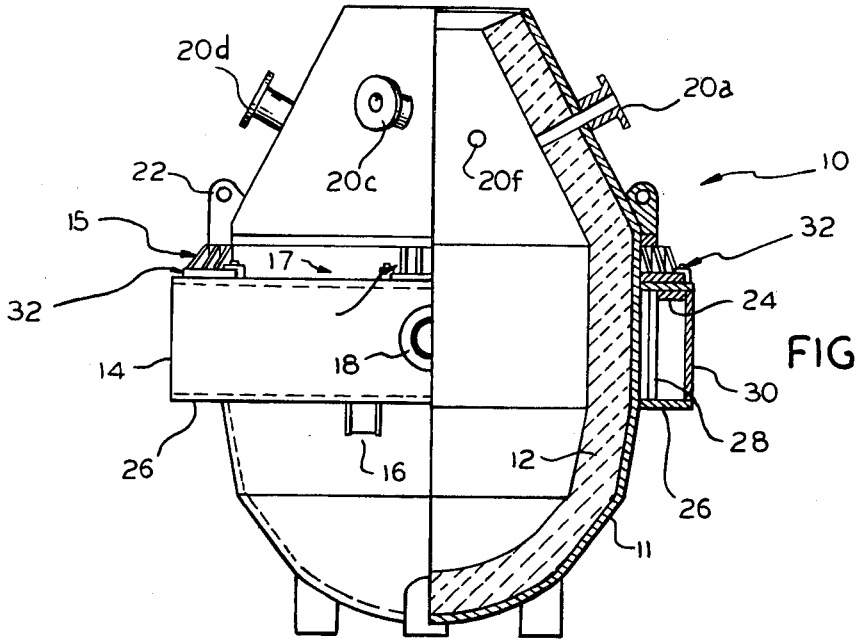
FIG. 1 is a side elevational view, partly in section, of a metallurgical vessel incorporating the present invention.

The invention will be illustrated in connection with the vessel 10 shown in FIG. 1 to be converter vessel open at its upper end and which has a metallic shell 11 and a refractory lining 12. Means (not shown) but which are well known in the art may be provided for delivering oxygen to a molten metal charge contained within the vessel. Such oxygen delivery means may comprise a removable lance (not shown) which is inserted through the open, upper end of vessel 10 or tuyeres (not shown) for delivering oxygen and other gases such as hydrocarbon shielding fluid or argon either through the side or bottom of the vessel. It will be appreciated that it is not intended to limit the invention to a vessel having any particular type of oxygen delivery system.

The vessel 10 is supported on a trunnion ring 14 by means of the upper support assembly 15, lower support assembly 16 and the adapter assembly 17 according to the present invention and which will be discussed in detail hereinbelow. A trunnion 18 extends from each of the opposite sides of the trunnion ring 14 in a generally coaxial relation and each is supported in a well known manner and bearing structures (not shown). In addition, a conventional drive apparatus (not shown) is connected to one of the trunnion pins 18 for tilting the vessel through its various operative positions to permit charging, deslagging, sampling, temperature measurement or discharge of hot metal through the teeming spout **20*a* which is arranged in a plane normal to the tilt axis of the trunnion pins 18. A plurality of secondary pouring spouts 20*b*, 20*c*, 20*d*, 20*e* and 20*f* are positioned around the vessel 10** at predetermined angular intervals.

The vessel 10 will normally be charged with hot metal or scrap and oxygen will be delivered in a conventional manner to perform the conversion operation.

Figure 2:
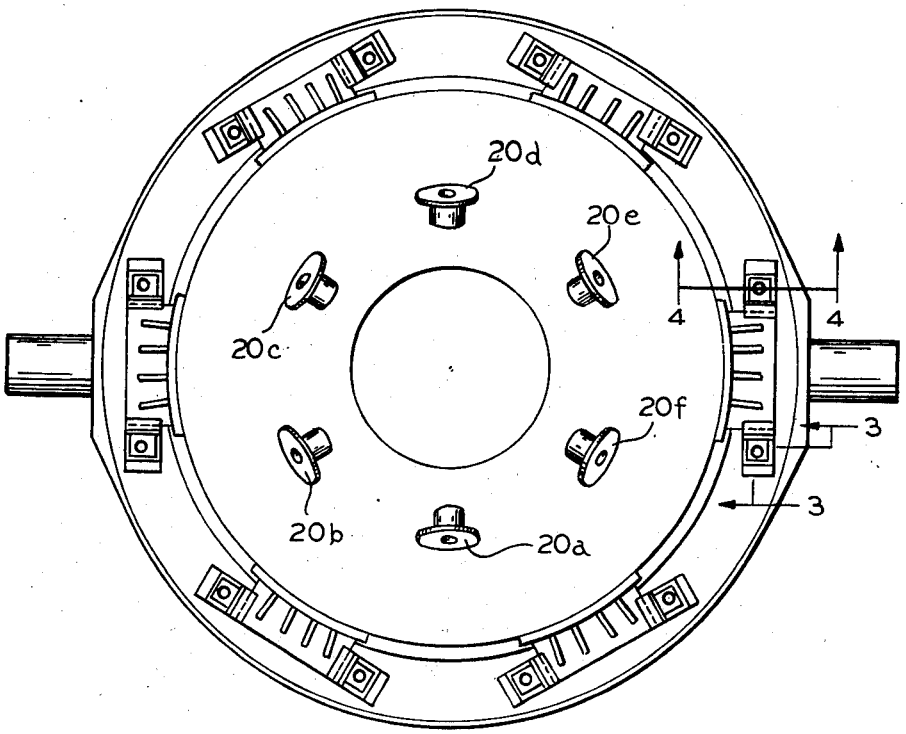
FIG. 2 is a top plan view of the vessel shown in FIG. 1.
Figure 3:
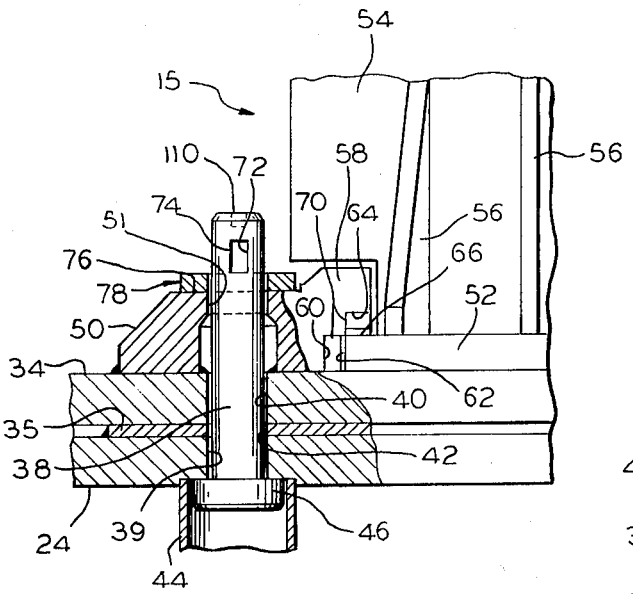
FIG. 3 is a view taken along lines 3—3 of FIG. 2.

The trunnion ring 14 as shown in FIGS. 1, 2 and 3 to be generally annular and includes an upper flange 24, a lower flange 26, an inner side wall 28 and an outer side wall 30. The upper support assembly 15 includes a plurality of conventional mounting brackets 32, which in prior art assemblies are normally mounted directly to the trunnion ring 14. However, in the preferred embodiment of the invention, the brackets 32 are coupled to the trunnion ring 14 through the adapter assembly 17. Specifically, the brackets 32 engage an adapter ring 34 which is substantially coextensive with the upper flange 24 and engages a plurality of flat, spaced apart spacer plates 35 which are welded to the top flange 24. A concentric ring 36 or shoulder is affixed to the outer periphery of the lower surface of ring 34 and cooperates with the outer surface of spacer plates 35 to prevent the spacer ring 34 from shifting when the vessel 10 is tilted.

The adapter ring 34 is releasably securable to the trunnion ring 14 in any one of a plurality of angular positions by means of a plurality of key bolts 38 which are extendable into apertures 39 and 40 in the top flange 24 and ring 34 respectively. The number of apertures 39 and 40 are determined by the number of top brackets 32, which in the illustrated example number six so that the top flange 24 has holes 39 extending between its upper and lower surfaces and spaced apart at 30° intervals. Similarly, the adapter ring 34 has 12 spaced apart holes 40 which are each simultaneously registrable with one of the holes 39 as shown in FIG. 3. The openings 39 and 40 have substantially the same diameter and each of the spacer plates 35 has a similarly sized opening 42 which is coaxial with opening 39. Affixed to the top flange 24 below each opening 38 and arranged concentrically relative thereto is a retainer cup 44 in which retainer bolt 38 is disposed. Each bolt 38 has an enlarged head 46 at its lower end and its height is such that when head 46 rests on the bottom of cup 44, the upper end of bolt 38 is just below the upper surface of the spacer plates 35. Cups 44 may be sealed in a water tight relation so that water may be circulated within ring 14 for cooling the same.

Disposed above each of the opening 40 in adapter ring 34 is a gib 50 which has an opening 51 coaxial with opening 40. The gibs 50 form a portion of each bracket assembly 15 and are disposed at the opposite ends thereof. More specifically, each bracket assembly 15 includes a generally planer foot plate 52 which engages the ring 34, a mounting plate 54 which is suitably secured to vessel 10 such as by welding or bolts, and a plurality of fins 56 which extend between and are suitably affixed to the plates 52 and 54 whereby the weight of the vessel is transmitted to the adapter ring 34. The spacer plates 35 are preferably coextensive with or slightly larger than the foot plates 52 to maximize the support area of the trunnion ring 14 relative to the adapter ring 34. Each gib 50 is suitably affixed to the ring 34 such as by welding and includes a shoulder portion 58 which extends inwardly toward and overlays one end of the foot plate 52. Formed on shoulder portion 58 are a first obliquely extending vertical surface 60 disposed adjacent the vertical surface 62 of foot plate 52 and a second obliquely extending surface 64 which is disposed above the end surface 66 of foot plate 52. This provides a pair of tapered gaps between the gib shoulder 58 and the foot plate 52. Received in each of these gaps is a tapered shim 70 which may be suitably wedged in position such as by bolts (not shown) but which extend through aligned threaded openings in the shims 70 and the gib shoulder portion 58. In this manner, each of the brackets 15 may be tightly secured to the top plate 34. For a more complete description of the top brackets 15 reference is made to U.S. Pat. No. 3,561,744.

Figure 4:
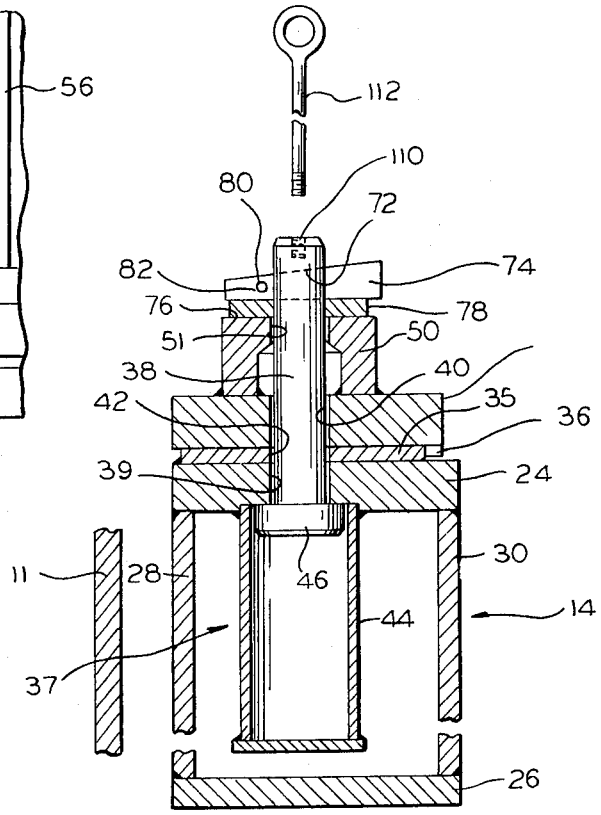
FIG. 4 is a view taken along lines 4—4 of FIG. 2.

It will be appreciated that any suitable number of top brackets 15 may be employed although in the illustrated embodiment six such brackets are provided for purposes of illustration. When six top brackets 15 are employed, an opening 39 in the top flange 24 and 40 in the adapter plate 34 are provided for each gib or a total of twelve. Preferably, the center angles formed by each pair of openings are 30° and similarly each gib 50 and particularly its opening 51 intercepts similar central angles. It will be appreciated, therefore, that by elevating and rotating the vessel 10 along with the adapter plate 34 through angles which are multiples of 30°, the vessel 10 can be affixed in any one of twelve positions relative to the trunnion ring 14. Of course, the number of gibs 50 need not be the same as the number of openings in the trunnion ring top flange 24. For example, there could be two, four, six, or eight top brackets depending upon the vessel design and any number of spaced apart openings, with the central angles between openings determining the number of possible vessel positions. FIGS. 3 and 4 shows the retainer bolt 38 to include a generally rectangular tapered opening 72 which extends diametrically therethrough and for receiving a tapered wedge key 74 therein. The retaining bolt 38 is shown in its clamped position by full lines in FIG. 3 wherein the head 46 engages the lower surface of top flange 24 and its shank extends upwardly through openings 39, 40, 42 and 51 to position the opening 72 above the flat upper surface 76 of the gib 50. A washer 78 is disposed between surface 76 and the lower edge of key 74 which is tightly wedged within opening 72. When in this position, the retainer bolts 38 secure the adapter ring 34 to the top flange 24. A transverse aperture 80 may be provided in the wedge key 78 as shown in FIG. 4 for receiving a retainer pin 82 to prevent the inadvertent removal of wedge key 74 from tapered slots 72.

Figure 6:
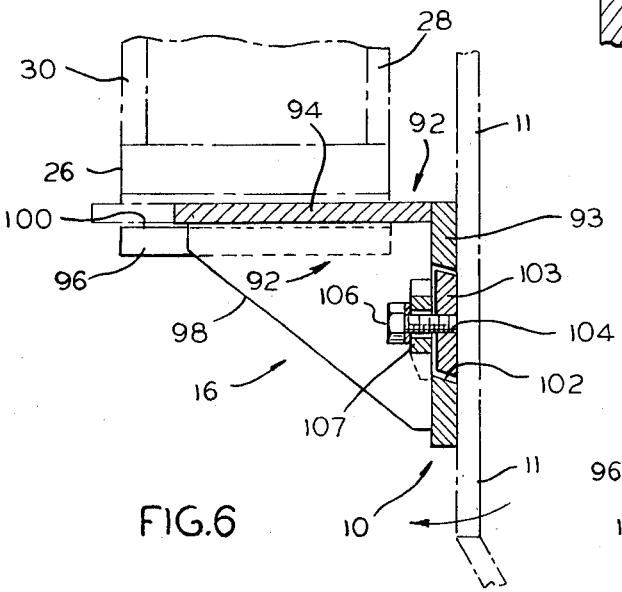
FIG. 6 is a view taken along lines 6—6 of FIG. 5.
Figure 5:
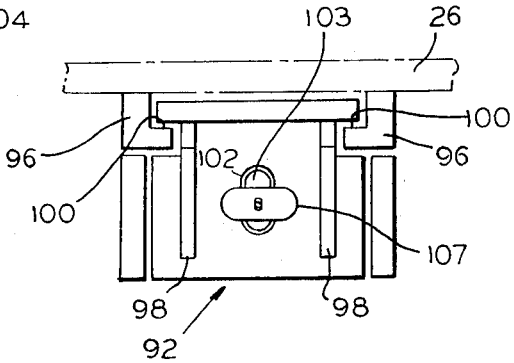
FIG. 5 illustrates a portion of the support assembly of the apparatus of FIG. 1.

The lower support assemblies 16 may take any convenient form for providing stability to the vessel 10 during rotation. One example of a suitable lower mounting assembly 16 is shown in FIGS. 5 and 6. Each of the illustrated lower support assemblies includes a stabilizer bracket 92 slidably supported below the trunnion ring bottom flange 26 for movement into and out of engagement with the shell 11 of vessel 10. Bracket 92 includes a first plate 93 for bearing against the shell 11 and a second plate 94 slidably supported beneath the lower trunnion ring flange 26 by a pair of rails 96. The plates 93 and 94 are joined at substantially a right angle by brace members 98 whereby the plate 93 may bear against the surface of vessel 10 while plate 94 is disposed in a generally parallel relation to bottom bracket 26. The rails 96 are each elongated and generally L-shape in transverse cross section and their lower edges facing inwardly. The plate 94 and hence the bracket 92 is slidably mounted on the inner surfaces 100 of rails 96 of the lateral movement toward and away from vessel 10.

A generally obround aperture 102 is formed in plate 93 for receiving a similarly shaped but somewhat smaller member 103 affixed to vessel 10. Member 103 has a threaded aperture 104 for receiving a bolt 106 which serves to retain an obround washer 107. When the stabilizer bracket 92 is in its engaged position relative to vessel 10 as shown by full lines in FIG. 5, the aperture 102 and the member 103 are oriented generally vertically while the washer 107 is normally oriented horizontally to prevent movement of the bracket 92 away from vessel 10.

It will be appreciated that initially, one of the pouring spouts, 20*a* for example, will be oriented with its axis normal to a plane containing the tilt axis of the vessel while the remaining pouring spouts 20 are plugged with refractory. Accordingly, when the vessel is tilted at the completion of a refining operation, molten metal will discharge through spout 20*a*. After a number of refining operations, the refractory in the area of the operative pouring spout 20*a* will become warped and worn so that the vessel must be repositioned relative to trunnion ring 14 whereby a different pouring spout is in operative position. Toward this end, the vessel 10 is released from the trunnion ring 14, elevated, rotated to place a different one of the pouring spouts 20 in an operative position, and then it is lowered and recoupled to trunnion ring 14. In order to uncouple the vessel 10 from trunnion ring 14, each of the retainer pins 82 are first removed after which the wedge keys 78 are removed from the tapered opening 72 in retainer bolts 40. This permits each of the retainer bolts 38 to drop downwardly into the container 44 with the upper end of bolt 38 below the lower surface of adapter ring 34. In addition, each of the bolts 103 of the lower support assembly 17 are loosened and the obround washers 107 are rotated 90° to coincide with the opening 102 in plates 103. The bracket members 102 are then free to be moved away from vessel 10 and from a position shown by full lines in FIG. 6 to a position shown by broken lines. When all the upper and lower assemblies 16 and 17 are thus disengaged, the vessel 10 may be elevated and rotated by any suitable apparatus. It will be understood that because the adapter plate 34 is attached to the vessel through the agency of the brackets 15, the ring 34 will be elevated and rotated along with the vessel. After rotation of the vessel through the desired angle, which in the case of an assembly having twelve sets of apertures, will be a multiple of 30°, the vessel is lowered to position the plate 34 on the spacer plates 35. Rotation of the vessel through this angle will bring the openings 40 in adapter ring 34 and the coaxial openings 48 in gibs 50 into alignment with a different one of the openings 39 in top flange 24. Similarly, a plurality of members 104 are arranged in spaced apart relation about the vessel and the angle between adjacent members will be the same as the angle between the openings 38 in the top flange 24. Accordingly, rotation of the vessel through the desired angle will also bring each stabilizer bracket 92 adjacent a different one of the members 103 so that upon movement of the brackets 92 toward the vessel, the stabilizer plates 93 can be secured against the vessel 11 as illustrated in FIG. 6. In addition, the retainer bolts 38 may be elevated through the aligned openings 39, 40 and 48 in any suitable manner and resecured by the wedge keys 74. For example, each retainer bolt 48 may have a threaded recess 110 formed coaxially in its upper end and adapted to receive the threaded lower end of an eye-lift bolt 112. When the lower end of bolt 112 is screwed into opening 110, the bolt 38 may be elevated and held in position while the washer 76 is placed in surrounding relation and the wedge key 74 forced into its wedged position.

The adapter ring 34 may be formed in one piece or any number of detachable segments. For example, the ring 34 may be fabricated from six wedged shaped sections each of which carries a pair of gibs so that individual bracket replacement may be achieved. If a segmented ring is employed, the segments may be joined in any convenient manner which permits separation.

Figure 7:
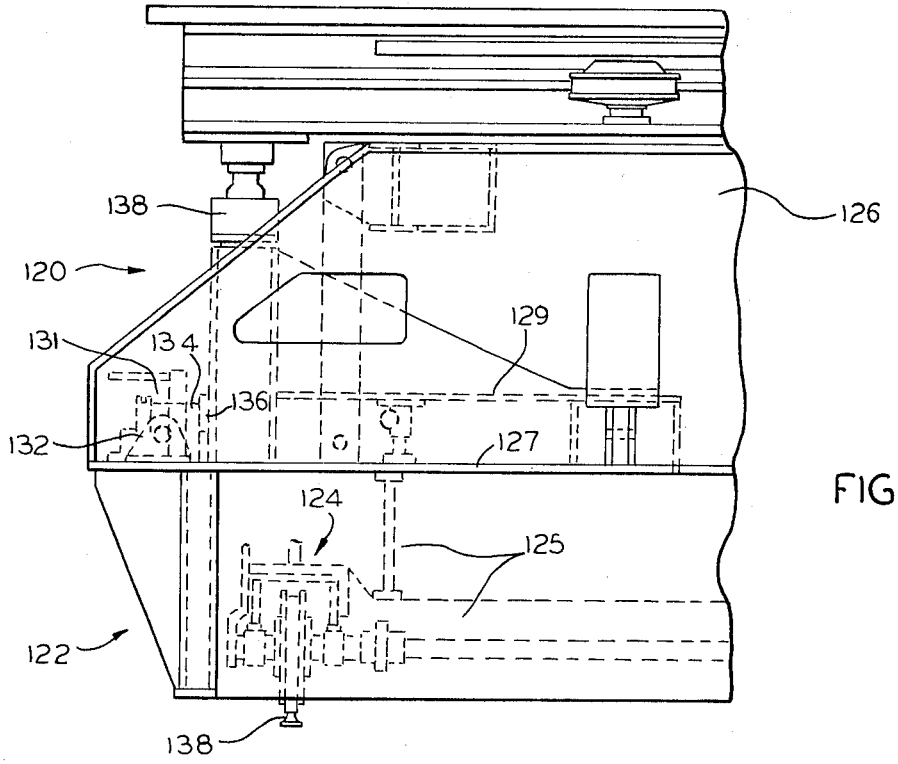
FIGS. 7 and 8 illustrate an elevating and rotating mechanism usable with the vessel of FIG. 1.
Figure 8:
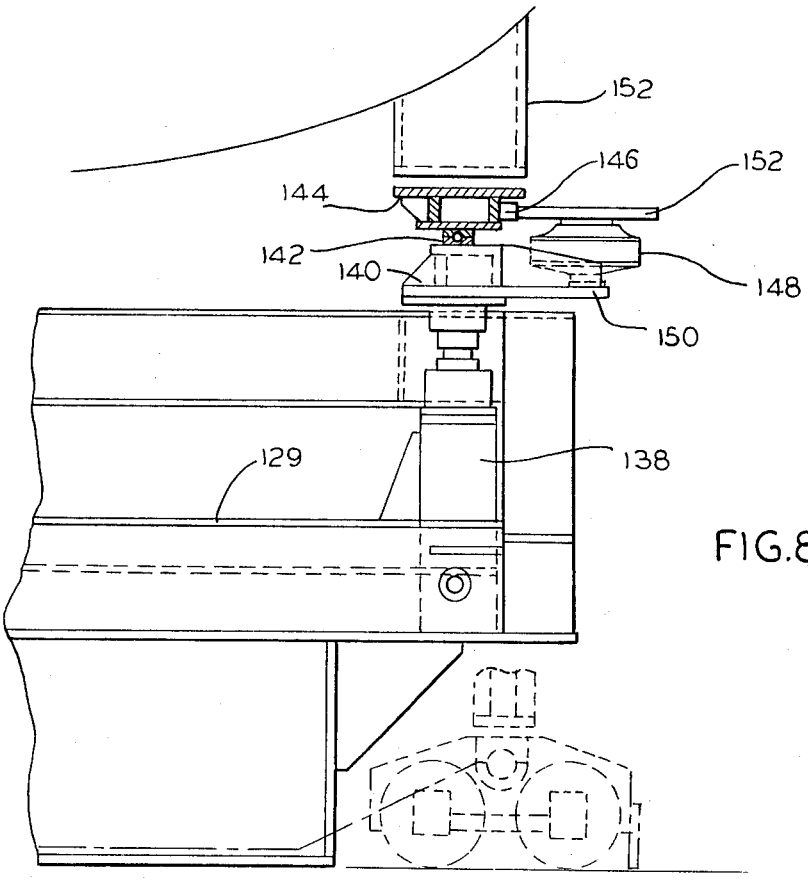

While any well known apparatus for elevating and rotating the vessel 10 may be employed, FIGS. 7 and 8 illustrate one type of apparatus which may be employed for this purpose. Specifically, the elevating apparatus 120 is mounted atop a conventional teeming ladle car 122 which includes a truck assembly 124 at each of the four corners of the car and a frame 125 which in turn supports a teeming ladle mount consisting of a side frame 126 and a bed 127. The elevating apparatus also includes a frame 129 which is supported on the bed 127 by means of four side adjustment jacks 131, one of which is located at each corner of the assembly. While the side adjustment jacks are not shown in detail, they include a stationary portion 132 and a screw shaft 134 extending between stationary portion 132 and in general parallelism with the axis of trucks 124. A stationary nut 136 is affixed to the frame 129 for receiving the screw shaft 134. It will be appreciated, therefore, that when the screw shafts 134 are rotated, the frame 129 will move in a direction normal to the direction that the car 122 moves on rails 138. It will be appreciated that suitable bearings (not shown) may be provided between the frame 129 and the bed 127 to support the vertical loading between the mechanism 120 and the car 122. Mounted at each of the four corners of frame 129 is a vertically extending lift cylinder 138, the upper end of which engages an annular lift ring 140. The ring 140 is thus supported in each quadrant by one of the lift cylinders 138. Mounted at the upper end of the support ring is the lower cage portion of an annular ball bearing assembly 142. On the upper cage portion of the ball bearing assembly 142 is a vessel support ring which is substantially coextensive with and is disposed above the lift ring 140. Fixed to the outer surface of the support ring 144 is a ring gear 146. A hydraulic motor 148 is mounted on a shelf 150 extending outwardly from the lift ring 140 and coupled to its vertically extending shaft is a roller chain mechanism 152 which engages the ring gear 146. The vessel 10 may be provided with any suitable means adapted to be engaged by the ring 144.

While only a single embodiment of the invention has been illustrated and described, it is not intended to be limited thereby, but only by the scope of the appended claims. For example, while an annular trunnion ring 14 is shown, an open ended or U-shaped support may also be employed. Also, there may be different numbers of brackets and pouring spouts than that shown.

I claim:

1. A refractory lined metallurgical vessel, trunnion support means, adapter means engageable with said trunnion support means, a plurality of mounting means for affixing said vessel to said adapter means, releasable coupling means for affixing said adapter means to said trunnion support means so that said vessel may be tilted to discharge metal therefrom, and said releasable coupling means including a first plurality of member receiving means mounted on said adapter means and a second plurality of member receiving means on the trunnion support means, a plurality of members each mounted in the trunnion support for movement into and out of the member receiving means on the adapter means when the same are in alignment, one of said members being in operative orientation with one member receiving means of each of said trunnion support means and said adapter means in each of a plurality of relative angular positions of said adapter means and said trunnion support means, and releasable connector means associated with each of said members and being releasably engageable therewith to releasably secure said members in said aligned member receiving means, said trunnion support means having hollow member receiving regions, said members being mounted in said trunnion support means for movement into and out of said member receiving means so that said members are movable out of said member receiving means and wholly into said trunnion support means whereby said vessel and adapter may be rotated about said second axis relative to said trunnion support means.

2. The metallurgical vessel set forth in claim 1 wherein said vessel has a generally horizontal tilt axis and a second axis generally normal to said tilt axis, said first and second plurality of member receiving means each being disposed equidistant from said second axis and in equiangular spaced relation thereto whereby rotation of said vessel about said second axis and relative to said trunnion support means will move different ones of said first plurality of member receiving means into and out of operative orientation with individual ones of said second plurality of member receiving means.

3. The vessel set forth in claim 2 wherein said first and second member receiving means include apertures formed respectively in said adapter means and an adjacent surface of said trunnion support means, said members being movable through said apertures when said adapter is oriented such that the aperture therein is in registry with the apertures in said trunnion support.

4. A refractory lined metallurgical vessel having a generally horizontal tilt axis and a second axis generally normal to said tilt axis, generally hollow trunnion support means having an upper surface, adapter means, a plurality of mounting means for affixing said vessel to said adapter means, releasable coupling means for affixing said adapter means to said trunnion support means so that said vessel may be tilted to discharge metal therefrom, and said releasable coupling means comprising a first plurality of spaced apart apertures formed in said adapter means and a second plurality of spaced apart apertures formed in the upper surface of said trunnion support means, said first and second plurality of apertures being disposed equidistant from said second axis and in equiangular spaced relation thereto whereby rotation of said vessel about said second axis and relative to said trunnion support means will move different ones of said first plurality of apertures into and out of operative orientation with individual ones of said second plurality of apertures, a plurality of coupling members mounted in said trunnion support means for movement through said apertures when said adapter means is oriented such that the aperture therein is in registry with the aperture in the upper surface of said trunnion support means.

and member support means within said trunnion support means for supporting said members adjacent the aperture in said trunnion support means and below the upper surface thereof so that release of said members will allow the same to move into said member support means whereby said vessel and adapter means may be rotated about said second axis relative to said trunnion support means.

5. The vessel set forth in claim 4 wherein said members comprise elongate bolt means, each of said bolt means having a transverse opening extending through its upper end, and key means movable into and out of said transverse openings for securing said bolt means in an elevated position with its upper end disposed above said adapter means to secure said adapter means to said trunnion support means, head means formed on each of said bolt means and disposed below its associated opening in said trunnion support.

6. The vessel set forth in claim 5 and including a plurality of bracket means affixed to said vessel, said bracket means having a plate portion extending outwardly from said vessel and engagable with said adapter means, and bracket engaging means mounted on said adapter means for releasably securing said plate means to said adapter means, said bracket means engaging means being disposed adjacent the aperture in said adapter means and said bracket engaging means having an aperture in alignment therewith, said bolt means being extendable through the aperture in said bracket engaging means.

7. A refractory lined metallurgical vessel having a generally horizontal tilt axis and a second axis generally normal to said tilt axis, generally annular trunnion support means having a generally planer upper surface, adapter means comprising a generally annular member, a plurality of mounting means for affixing said adapter means to said vessel, said adapter means having a generally planer lower surface presented toward said trunnion support means, releasable coupling means for affixing said adapter means to said trunnion support means so that said vessel may be tilted to discharge metal therefrom, and said releasable coupling means comprising a first plurality of spaced apart apertures formed in said adapter means and a second plurality of spaced apart apertures formed in the upper surface of said trunnion support means, said first and second plurality of apertures being disposed equidistant from said second axis and in equiangular spaced relation thereto whereby rotation of said vessel about said second axis and relative to said trunnion support means will move different ones of said first plurality of apertures into and out of operative orientation with individual ones of said second plurality of apertures, a plurality of coupling members mounted on one of said trunnion support means and adapter means for movement through said apertures when said adapter means is oriented such that the aperture therein is in registry with the aperture in the upper surface of said trunnion support.

8. The metallurgical vessel set forth in claim 7 and including locking means associated with each of said members and selectively movable into and out of locking engagement therewith to secure said coupling members in said apertures.

9. A refractory lined metallurgical vessel, a generally annular trunnion support means having a generally planer upper surface, adapter means comprising a generally annular member affixed to said vessel and having a relatively planer lower surface presented toward the upper surface of said trunnion support means, a plurality of mounting means for affixing said vessel and to said adapter means, releasable coupling means for affixing said adapter means to said trunnion support means so that said vessel may be tilted to discharge metal therefrom, and said releasable coupling means including indexing means associated with said vessel and said trunnion support means and having a plurality of angularly related indexing positions whereby said adapter means may be affixed to said trunnion support means in each of a plurality of relative angular positions, said indexing means comprising a plurality of apertures in said adapter means and trunnion support means and members mounted on one of said adapter or trunnion support means and movable into and out of coupling engagement with said apertures and locking means associated with each of said members and selectively movable into and out of locking engagement therewith to secure said coupling members in said apertures.

10. The vessel set forth in claim 9 wherein said trunnion support means is generally hollow, said members are mounted in said trunnion support means for movement into and out of said apertures, and member support means within said trunnion support means for supporting said members adjacent the opening in said trunnion support means and below the upper surface thereof so that release of said members will allow the same to move into said member support means whereby said vessel and adapter may be rotated about said second axis relative to said trunnion support means.

11. The vessel set forth in claim 10 wherein said members comprise elongate bolt means, each of said bolt means having a transverse opening extending through its upper end, and key means movable into and out of said transverse openings for securing said bolt means in an elevated position with its upper end disposed above said adapter means to secure said adapter means to said trunnion support means, head means formed on each of said bolt means and disposed below its associated opening in said trunnion support means.

12. The vessel set forth in claim 11 and including a plurality of bracket means affixed to said vessel, said bracket means having a plate portion extending outwardly from said vessel and engagable with said adapter means, and bracket engaging means mounted on said adapter means for releasably securing said plate means to said adapter means, said bracket engaging means being disposed adjacent the aperture in said adapter means and said bracket engaging means having an aperture in alignment therewith, said bolt means being extendable through the aperture in said bracket engaging means.

13. The vessel set forth in claim 12 wherein said trunnion support means has a lower surface displaced from said upper surface, and a plurality of vessel stabilizing means mounted on the lower surface of said trunnion support means and movable thereon into and out of engagement with said vessel.

14. A refractory lined metallurgical vessel, a trunnion support surrounding said vessel and having a top portion, generally annular adapter means, a plurality of mounting means for affixing said vessel to said adapter means, releasable coupling means for affixing said adapter means to said trunnion support so that said vessel may be tilted to discharge metal therefrom, and said releasable coupling means including a plurality of apertures formed in said adapter means and a plurality of members mounted on said trunnion support and each being receivable in one of said apertures when said vessel is in each of a plurality of angular positions relative to said trunnion support, and means for releasably securing said members in said apertues, whereby said adapter means may be affixed to said trunnion support in each of a plurality of relative angular positions.

15. The vessel set forth in claim 14 wherein said vessel has a generally horizontal tilt axis and a second axis generally normal thereto, engagable means mounted on the lower end of said vessel, vessel elevating means comprising a ring coaxial with said second axis, means for elevating said ring into engagement with said engagable means, tooth means formed on the outer periphery of said ring, and a vessel supported thereon.

16. The metallurgical vessel set forth in claim 14 wherein said vessel has a generally horizontal tilt axis and a second axis generally normal to said tilt axis, said plurality of apertures each being disposed equidistant from said second axis and in equiangular spaced relation thereto whereby rotation of said vessel about said second axis and relative to said trunnion support means will move different ones of said plurality of apertures into and out of operative orientation with individual ones of said members.

17. The vessel set forth in claim 14 wherein said trunnion support is generally hollow, said members being mounted in said trunnion support for movement into and out of said apertures, and member support means within said trunnion support for supporting said members within said trunnion support and below the upper surface thereof so that release of said members will allow the same to move into said member support whereby said vessel and adapter may be rotated about said second axis relative to said trunnion support means.

18. The vessel set forth in claim 17 wherein said members comprise elongate bolt means, each of said bolt means having a transverse opening extending through its upper end, and key means movable into and out of said transverse openings for securing said bolt means in an elevated position with its upper end disposed above said adapter means to secure said adapter means to said trunnion support, head means formed on each of said bolt means and disposed within said trunnion support.

19. The vessel set forth in claim 18 and including a plurality of bracket means affixed to said vessel, said bracket means having a plate portion extending outwardly from said vessel and engagable with said adapter means, and bracket engaging means mounted on said adapter means for releasably securing said plate means to said adapter, said bracket engaging means being disposed adjacent the aperture in said adapter means and said bracket engaging means having an aperture in alignment therewith, said members being extendable through the aperture in said bracket engaging means.

* * * * *